US005596888A

United States Patent [19]

McLarty, III et al.

[11] Patent Number: 5,596,888

[45] Date of Patent: Jan. 28, 1997

[54] KNITTED FURNITURE SUPPORT FABRIC

[75] Inventors: George C. McLarty, III, Greenville; Anthony R. Waldrop, Easley; Paul S. Loadholdt, Spartanburg, all of S.C.

[73] Assignee: Milliken Research Corporation, Spartanburg, S.C.

[21] Appl. No.: 546,639

[22] Filed: Oct. 23, 1995

[51] Int. Cl.[6] ..... D04B 21/00

[52] U.S. Cl. ..... 66/195; 66/192

[58] Field of Search ..... 66/190, 191, 192, 66/193, 194, 195

[56] References Cited

U.S. PATENT DOCUMENTS

| | | | |
|---|---|---|---|
| 2,433,279 | 12/1947 | Johnson | 66/195 X |
| 3,069,885 | 12/1962 | Cooper et al. | 66/195 |
| 3,448,595 | 6/1969 | Bahzer et al. | 66/195 X |
| 4,075,874 | 2/1977 | Hemberger | 66/195 X |
| 4,168,602 | 9/1979 | Thompson | 57/243 |
| 4,265,961 | 5/1981 | Bena | 428/253 |
| 4,469,739 | 9/1984 | Gretzinger et al. | 428/198 |
| 4,817,400 | 4/1989 | Baesgen et al. | 66/195 |
| 4,844,969 | 7/1989 | Chang | 66/195 X |
| 5,027,618 | 7/1991 | Robinson et al. | 66/202 |
| 5,209,084 | 5/1993 | Robinson et al. | 66/196 |
| 5,215,807 | 6/1993 | Day et al. | 428/193 |
| 5,235,826 | 8/1993 | Brooks et al. | 66/169 R |
| 5,373,712 | 12/1994 | Yamamoto et al. | 66/195 |
| 5,382,466 | 1/1995 | Ingham | 66/195 X |
| 5,393,596 | 2/1995 | Tornero et al. | 66/192 X |
| 5,424,110 | 6/1995 | Tornero et al. | 428/114 |
| 5,502,985 | 4/1996 | Matsuda et al. | 66/192 X |

FOREIGN PATENT DOCUMENTS

| | | |
|---|---|---|
| 0529671A2 | 8/1992 | European Pat. Off. . |
| 2225034 | 5/1990 | United Kingdom . |

*Primary Examiner*—John J. Calvert

*Attorney, Agent, or Firm*—Terry T. Moyer; James M. Robertson

[57] ABSTRACT

The present invention provides a knitted furniture support fabric having multi-directional stretch characteristics and possessing sufficient strength and durability to function as a support in a seating or bed structure. The furniture support fabric of the present invention is a four bar knit structure including two yarns of textured polyester and two yarns of elastomeric monofilament knit together such that the fabric has an elongation at break of at least 17 percent in both the warp and fill directions.

10 Claims, 1 Drawing Sheet

KNITTED FURNITURE SUPPORT FABRIC

FIELD OF THE INVENTION

This invention relates generally to furniture support fabric for disposition across a furniture frame and relates more particularly to a four bar knitted fabric construction using two bars of textured polyester yarn and two bars of monofilament yarn knitted together to form a strong lightweight material suitable as a support member in seat bottoms, and backs as well as in beds in lieu of box or wire springs. Such fabric possesses properties of high strength, low weight and multi-directional stretch with good recovery as required for performance under cyclical loading in the preferred environment of use.

BACKGROUND

Seating and bedding structures typically are constructed from a seating frame and cushions for occupant contact. However, most such structures will also typically require a subcushion support structure disposed across the seating frame to give the cushions the necessary support to provide a comfortable and secure feeling to the user. These support structures have traditionally been based around the concept of coils, spring constructions, sinuous wire and webbing making use of deformation according to spring constant characteristics of the construction being used so as to meet and respond to variable and cyclical loads.

The use of specially designed fabrics to either augment or replace traditional coils and springs is known. One such woven fabric is disclosed in U.S. Pat. No. 4,469,739 to Gretzinger et al. (incorporated herein by reference). The present invention provides a lightweight knitted construction furniture support fabric possessing the physical characteristics necessary for long-term use. In particular, the present invention provides a warp knitted fabric having multi-directional stretch characteristics. Accordingly, the present invention represents a useful advancement over the state of the art.

OBJECTS AND SUMMARY OF THE INVENTION

In view of the foregoing, it is a general object of the present invention to provide a knitted furniture support fabric having multi-directional stretch characteristics and possessing sufficient strength and durability to function as a support in a seating or bed structure.

It is a more particular object of the present invention to provide a knitted furniture support fabric which is light in weight.

It is a feature of the present invention to provide a knitted furniture support fabric having a four bar warp knit construction incorporating two bars of textured polyester and two bars of elastomeric monofilament yarn.

It is a further feature of the present invention to provide a furniture support fabric having a four bar warp knit construction and characterized by an elongation at break of about 17 percent or greater in both the warp and the fill directions.

It is yet a further feature of the present invention to provide a furniture support fabric having a four bar warp knit construction which has a weight of about 25 ounces per square yard or less.

Other objects, advantages and features of the invention will, of course, become apparent upon reading the following detailed description and by reference to the drawings below.

While the invention has been illustrated and will be described in connection with certain preferred embodiments and procedures, it is, of course, to be appreciated that we in no way intend to limit the invention to such particularly described embodiments and procedures. On the contrary, it is intended to include all alternatives, modifications and equivalents as may be included within the true spirit and scope of the invention as may be defined by the claims appended hereto.

DESCRIPTION OF THE PREFERRED EMBODIMENTS

Figure 1:
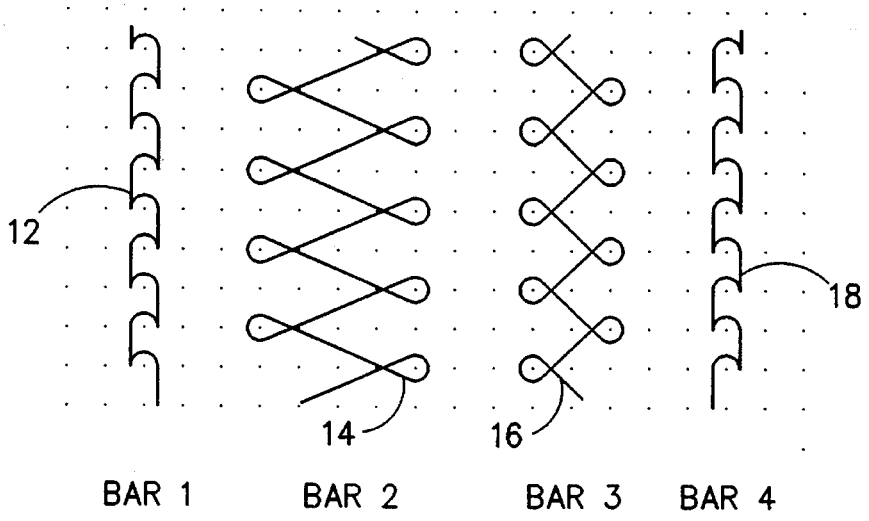
FIG. 1 is a composite needle bar diagram illustrating the configuration of each bar stitch within a preferred embodiment of the knit fabric of the present invention.

Turning now to the drawings, wherein like reference numbers designate like elements in the various views, in FIG. 1 there is shown a potentially preferred stitch arrangement for the knit furniture support fabric of the present invention.

The potentially preferred embodiment, the furniture support fabric is a four bar warp knit fabric knitted on a six gauge Raschel knitting machine. The Bar 1 yarn 12 and Bar 2 yarn 14 are preferably textured polyester yarns having deniers between about 70 and about 450. By way of example only, and not limitation, one potentially preferred textured polyester yarn is a two ply 150 denier yarn having 34 filaments per ply which is believed to be available from DuPont Fibers in Wilmington, Del. under the trade designation 56T.

Figure 2:
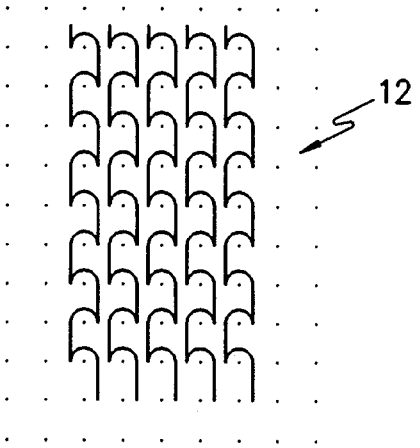
FIG. 2 illustrates the repeating arrangement of the yarn in Bar 1 shown in FIG. 1.

As best illustrated in FIG. 2, Bar 1 yarn is knitted in the fabric in a full chain stitch arrangement as will be well known to those of skill in the art. In the potentially preferred practice of the present invention, the particular stitch notation for the Bar 1 yarn is 1-0/0-1//.

Figure 3:
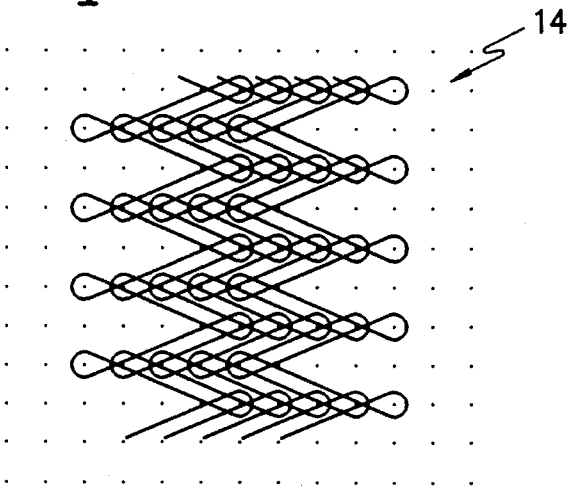
FIG. 3 illustrates the repeating arrangement of the yarn of Bar 2 shown in FIG. 1.
Figure 4:
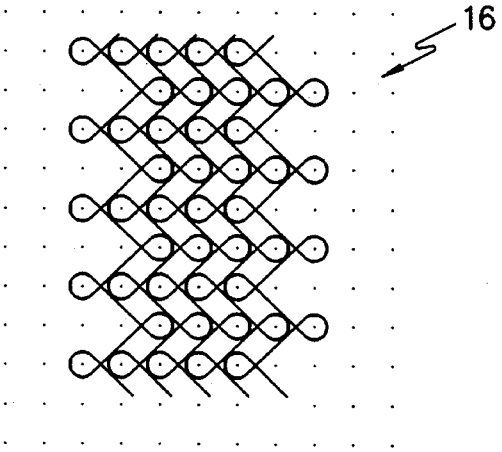
FIG. 4 illustrates the repeating arrangement of the yarn of Bar 3 shown in FIG. 1.

As best illustrated in FIG. 3, the Bar 2 yarn 14 is knitted in the fabric in a looped crossing pattern. In the illustrated and potentially preferred practice, the particular stitch notation for the Bar 2 yarn is 4-5/1-0//.

In the preferred practice, the Bar 3 yarn 16 and Bar 4 yarn 18 are elastomeric monofilament yarns. One such monofilament yarn is believed to be available under the trade designation Elas-Ter™ monofilament marketed by Hoechst Celanese Fibers Corporation group in Charlotte, N.C. In a particularly preferred practice, the monofilament in Bar 3 and Bar 4 will have a denier of about 400 although it is believed that yarn deniers between about 300 and about 800 may be utilized.

Figure 5:
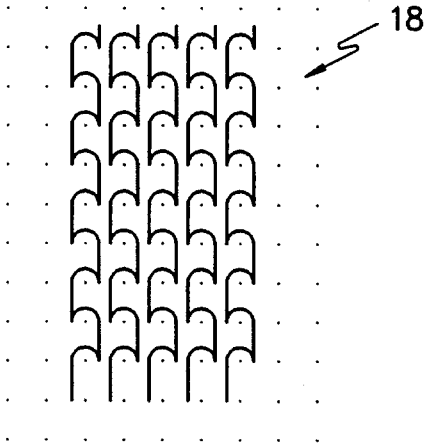
FIG. 5 illustrates the repeating arrangement of the yarn of Bar 4 shown in FIG. 1.

As best illustrated in FIG. 5, the Bar 4 yarn 18 is preferably knitted in a chain stitch in opposing orientation to the stitch arrangement for the Bar 1 yarn 12 previously described. Accordingly, in the preferred practice of the present invention, the preferred stitch notation for the Bar 4 yarn is 0-1/1-0//.

Bar 3 yarn 16 is preferably used in a looped crossing pattern incorporating a stitch notation 1-0/2-3// tying together the augmenting chain stitches of Bar 1 yarn 12 and Bar 4 yarn 18 with the Bar 2 yarn 14 serving to form a textured base for the other adjoined yarns.

The above description and related figures describe and illustrate a preferred practice for producing a knit furniture support fabric which exhibits multidirectional stretch and recovery. In order to more fully illustrate the concepts of the subject invention, the following examples are given. However, it is to be understood that any such examples are provided for illustrative purposes only and should in no way be construed as unduly limiting the scope of the invention which is defined and limited only by the scope of the appended claims and equivalents thereto.

EXAMPLES 1–8

Each of eight fabric samples having the construction as shown in FIGS. 1–5 above was knitted on a six gauge knitting machine with a construction on the machine of 22 courses per inch and 6 wales per inch yielding finished constructions as shown in Table I. Bars 1 and 2 were single ply 150 denier textured polyester having 34 filaments per yarn. Bars 3 and 4 were 400 denier Elas-Ter™ monofilament. The fabric was heat set at 340° F. after which the physical properties of the fabric were measured.

Physical properties of weight, ball burst, warp torque, tear and tensile strength in both the warp and fill directions are set forth in Table II. Elongation properties for each of the eight fabric samples are set forth in Table III (Warp) and Table IV (Fill).

TABLE I

SAMPLE CONSTRUCTIONS

| Sample Number | Wales/Inch | Courses/Inch |
|---|---|---|
| 1 | 6 | 18 |
| 2 | 6 | 18 |
| 3 | 6 | 17 |
| 4 | 9 | 26 |
| 5 | 12 | 30 |
| 6 | 12 | 31 |
| 7 | 7 | 21 |
| 8 | 7 | 21 |

TABLE II

SAMPLE PHYSICAL MEASUREMENTS

| Sample No. | Weight Oz./Sq. Yd. | Ball Burst (Pounds | Tongue Tear Warp (Pounds) | Peak Grab Tensile Warp (Pounds) | Peak Grab Tensile Weft (Pounds) |
|---|---|---|---|---|---|
| 1 | 6.39 | 102 | 13.3 | 77.7 | 86 |
| 2 | 6.34 | 107 | 13.7 | 81 | 80.9 |
| 3 | 5.36 | 108 | 11.6 | 65.4 | 78.2 |
| 4 | 11.89 | 149 | 13.2 | 93 | 124.6 |
| 5 | 20.87 | N/A | 18.1 | 138 | 156 |
| 6 | 20.66 | N/A | 17.3 | 139.2 | 154.9 |
| 7 | 8.38 | 133 | 14.1 | 84.9 | 108.3 |
| 8 | 8.28 | 137 | 13.4 | 81.9 | 111.3 |

TABLE III

SAMPLE ELONGATION MEASUREMENTS - WARP

| Sample No. | Load @ 5% Elongation (Pounds) | Load @ 15% Elongation (Pounds) | Load @ 25% Elongation (Pounds) | Load @ 50% Elongation (Pounds) | % Elongation @ Break |
|---|---|---|---|---|---|
| 1 | 8.9 | 42.1 | 63.2 | N/A | 26.8 |
| 2 | 8.7 | 42.8 | 71.8 | N/A | 27.2 |
| 3 | 8.5 | 52.6 | 54.6 | N/A | 21.7 |
| 4 | 3.5 | 14.6 | 35.4 | N/A | 40.3 |
| 5 | 6.2 | 21.5 | 41.5 | 119 | 55.2 |
| 6 | 6.2 | 21.1 | 40.6 | 120.8 | 54.4 |
| 7 | 5.9 | 27.1 | 65.2 | N/A | 31.9 |
| 8 | 6.9 | 32.6 | 77.4 | N/A | 25.9 |

TABLE IV

SAMPLE ELONGATION MEASUREMENTS - FILL

| Sample No. | Load @ 5% Elongation (Pounds) | Load @ 15% Elongation (Pounds) | Load @ 25% Elongation (Pounds) | Load @ 50% Elongation (Pounds) | % Elongation @ Break |
|---|---|---|---|---|---|
| 1 | 10.1 | 61.5 | N/A | N/A | 18.6 |
| 2 | 9.6 | 59.2 | N/A | N/A | 18.4 |
| 3 | 5.1 | 59.9 | N/A | N/A | 17.5 |
| 4 | 1.9 | 12.9 | 47.5 | N/A | 37.8 |
| 5 | 3.3 | 11.6 | 21.4 | 70.9 | 71.5 |
| 6 | 3.2 | 11.2 | 21.1 | 76.2 | 68.7 |
| 7 | 4.7 | 34.6 | 99.4 | N/A | 26.4 |
| 8 | 3.2 | 23.2 | 77.2 | N/A | 30.3 |

While specific embodiments of the invention have been shown and described, it will be understood that the invention is in no way limited thereto, since modifications may be made and other embodiments of the principles of this invention will occur to those skilled in the art, Therefore, it is contemplated by the appended claims to cover any such modifications and other embodiments as incorporate the features of the present invention within the true spirit and scope of the following claims.

What is claimed is:

1. A furniture support material in a warp knitted configuration comprising: a first yarn of textured polyester disposed in a full chain stitch in Bar 1, a second yarn of textured polyester disposed in a traversing loop stitch in Bar 2, a first elastomeric monofilament yarn disposed in a traversing loop stitch in Bar 3, and a second elastomeric monofilament yarn disposed in a full chain stitch in Bar 4 and wherein said furniture support material has an elongation at break of about 17 percent or greater in both the warp and the fill direction.

2. The invention as in claim 1, wherein said first and second yarns of textured polyester have a denier of between 70 and about 450 and said first and second monofilament yarns have a denier of between about 300 and about 800.

3. The invention as in claim 1, wherein said first and second yarns of textured polyester have a denier of about 150 and said first and second monofilament yarns have a denier of about 400.

4. The invention as in claim 1, wherein said furniture support material has a weight of about 25 ounces per square yard or less.

5. The invention as in claim 4, wherein said first and second yarns of textured polyester have a denier of about 150 and said first and second monofilament yarns have a denier of about 400.

6. The invention as in claim 1, wherein said fabric is further characterized by a tensile strength in the warp direction of not less than about 65 pounds force in the warp direction and not less than about 78 pounds force in the fill direction.

7. The invention as in claim 6, wherein said first and second yarns of textured polyester have a denier of about 150 and said first and second monofilament yarns have a denier of about 400.

8. The invention as in claim 6, wherein said furniture support material is further characterized by tongue tear strength in the warp of between about 11 pounds and 18 pounds.

9. The invention as in claim 8, wherein said first and second yarns of textured polyester have a denier of about 150 and said first and second monofilament yarns have a denier of about 400.

10. A furniture support material in a warp knitted configuration having multi-directional stretch characteristics, the material comprising: a first yarn of textured polyester having a denier of about 150 disposed in a full chain stitch in Bar 1; a second yarn of textured polyester having a denier of about 150 disposed in a traversing loop stitch in Bar 2; a first elastomeric monofilament yarn disposed in a traversing loop stitch in Bar 3; and a second elastomeric monofilament yarn disposed in a full chain stitch in Bar 4; wherein said furniture support material has an elongation at break of about 17 percent or greater in both the warp and the fill directions and exhibiting an elongation of not less than about 5 percent at loads of 9 pounds in the warp direction and an elongation of not less than about 5 percent at loads of 10 pounds in the fill direction.

* * * * *